US005484311A

United States Patent [19]

Detwiler et al.

[11] Patent Number: 5,484,311

[45] Date of Patent: Jan. 16, 1996

[54] VARIABLE HEIGHT OUTBOARD MOTOR MOUNT

[75] Inventors: Timothy P. Detwiler, Coatesville; Charles G. Detwiler, Jr.; Edward C. Berdich, both of Downingtown; Peter M. Draper, Honey Brook, all of Pa.

[73] Assignee: Detwiler Industries, Inc., Honey Brook, Pa.

[21] Appl. No.: 203,411

[22] Filed: Feb. 28, 1994

[51] Int. Cl.[6] ..... B63H 20/08

[52] U.S. Cl. ..... 440/61; 248/641

[58] Field of Search ..... 440/61, 59, 60, 440/62, 58; 248/640, 641

[56] References Cited

U.S. PATENT DOCUMENTS 3,242,899 3/1966 Hanson ..... 248/641 X
3,834,345 9/1974 Hager et al. ..... 440/61 X
4,232,627 11/1980 Glenn et al. ..... 440/61
4,482,330 11/1984 Cook ..... 440/2

OTHER PUBLICATIONS

GMC Power Lift brochure; Cook Manuf. Co., Duncan, Okla. 1987.

Model–600 brochure; Hydro–Electric Transom; Land & Sea, North Salem, N.H. (Date Unknown).

*Primary Examiner*—Sherman Basinger
*Attorney, Agent, or Firm*—Howson & Howson

[57] ABSTRACT

A motor mount for varying the height of an outboard motor on the transom of a boat comprises a first bracket connected to a transom, and a second bracket connected to an outboard motor. A fluid-driven actuator effects movement of the second bracket relative to the first. One or more guides, each comprising a rod extending through a pair of vertically separated bearings fixed to the interior of a hollow, elongated tubular member, constrains the second bracket to vertical movement when the first bracket is connected to the transom of a boat.

20 Claims, 7 Drawing Sheets

VARIABLE HEIGHT OUTBOARD MOTOR MOUNT

BRIEF SUMMARY OF THE INVENTION

This invention relates to improvements in marine propulsion systems. It is specifically concerned with apparatus for varying the height of outboard motors on the transoms of boats.

Cavitation is a common problem with marine propulsion systems. Boat motors tend to draw water from the surface, which allows air as well as water to pass through the propeller. This results in cavitation or slippage of the propeller, reducing the efficiency of operation of the motor.

It is therefore important to avoid cavitation when operating marine propulsion systems, such as motor boat propellers. Outboard engines normally include a cavitation plate to prevent cavitation. This plate should be positioned to travel across the surface of the water while the motor is operating. At this location, the cavitation plate prevents air from reaching the propeller.

The height at which a cavitation plate is most effective varies depending upon various factors. A boat operating at low speeds, but retiring maximum thrust, will perform best when the cavitation plate is positioned one to three inches above the bottom of the boat. Racing boats, however, travel at higher speeds and are operated with the stern lower in the water. The optimum position for a cavitation plate for a racing boat is normally three to five inches above the bottom of the boat.

In the past, motors have been manually repositioned on boat transoms to accommodate changing operating conditions. For example, on a boat intended to be operated at high speeds, but which had previously been used for trolling, the motor is disconnected manually from the transom, raised a few inches, and then reattached to the transom. Boat motors, however, tend to be very heavy, making this procedure arduous and time-consuming.

Boats are also subjected to operating conditions which may vary during operation. For example, a boat with a motor mounted at a height appropriate for traveling at high velocities will have impaired performance until it comes up to speed. Low starting thrust cannot be counteracted by adjustment of the height of the propeller since it is impossible to adjust the height of the motor manually when the boat is underway.

U.S. Pat. No. 4,482,330, to Cook, describes an apparatus for mounting an outboard motor on the transom of a boat so that the motor can be raised and lowered on the transom. This apparatus includes a bracket attached to the transom, and another bracket attached to the engine. The motor bracket is slidably mounted on the transom bracket by bolt and slot assemblies. Each bolt and slot assembly comprises a bolt which passes through, and is slidable along, slots located in adjoining motor and transom brackets. This allows a reversible hydraulic pump, operating through an actuating cylinder, to move the motor mounting bracket relative to the bracket secured to the transom.

The bolts securing the brackets together must remain slidable within the slots so that the motor mounting bracket can move relative to the transom bracket. If the bolts are secured tightly the ability of the brackets to slide relative to each other is impaired. On the other hand, if the bolts are loose, the brackets can vibrate. Thus, it is difficult to maintain a tight fitting and stable structure. The bolts and slots are also exposed at the sides of the apparatus. This subjects the bolt and slot assemblies to the risk that foreign objects will enter into the unoccupied portions of the slots and block the path of the bolts.

The principal object of the invention is therefore to maximize outboard motor efficiency by providing a motor mount which varies the height of an outboard motor on the transom of a boat. Another object of the invention is to provide a motor mount utilizing a simple, strong, durable, and reliable mechanism to vary the height of an outboard motor on the transom of a boat. A further object of the invention is to provide a motor mount, capable of varying the height of an outboard motor on the transom of a boat, which is simple and inexpensive to manufacture and to install.

The motor mount in accordance with the invention comprises a first bracket connected to the transom of a boat, and a second bracket connected to an outboard motor. The first bracket has first and second plates. These plates are rigidly connected together, preferably by side plates, so that the first plate is disposed above the second plate. The second bracket has third and fourth plates. These plates are also rigidly connected together, preferably by side plates, so that the third plate is disposed above the first plate, and the fourth plate is disposed below the second plate.

A fluid-driven actuator effects movement of the second bracket relative to the first bracket. In the preferred embodiment, two guides are connected to the brackets for the purpose of constraining the movement of the second bracket to a substantially vertical path. Each guide has an elongated, tubular member connected to the first and second plates. A rod, extending through the tubular member, is rigidly connected to the third and fourth plates. A pair of bearings are mounted in the tubular member and are spaced from one another in the direction of the length of the tubular member. The rod extends through the bearings and is slidable therein, but held thereby against translation relative to its substantially vertical path.

The motor mount in accordance with the invention maximizes outboard motor efficiency by making it possible to vary the height of a motor on the transom of a boat while the boat is in operation. The rod and tube guide assemblies rigidly maintain the second bracket in a substantially vertical path, without impeding its movement relative to the first bracket, thereby enhancing the strength, durability, and stability of the mechanism.

The guides are preferably provided with seals to prevent water and foreign objects from entering into the tubes and causing corrosion obstructing the movement of the rods. This enhances the overall reliability of the mechanism.

A control system is provided to position the outboard motor at any desired height within a range. The control system selectively directs hydraulic fluid alternatively to one or the other of two ports in the actuator. It comprises command input means for entering a selected position for the outboard motor supporting bracket, position sensing means for providing a signal corresponding to the position of the outboard motor supporting bracket, and means, responsive to the command input means and to the position sensing means, for directing hydraulic fluid to the actuator to effect movement of the outboard motor supporting bracket in a direction to cause the position of the bracket to correspond to the selected position entered into the command input means. Preferably, the control is capable of positioning the outboard motor supporting bracket at any position within a range.

Further objects, details and advantages of the invention will be apparent from the following detailed description, when read in conjunction with the drawings.

DETAILED DESCRIPTION

Figure 1:
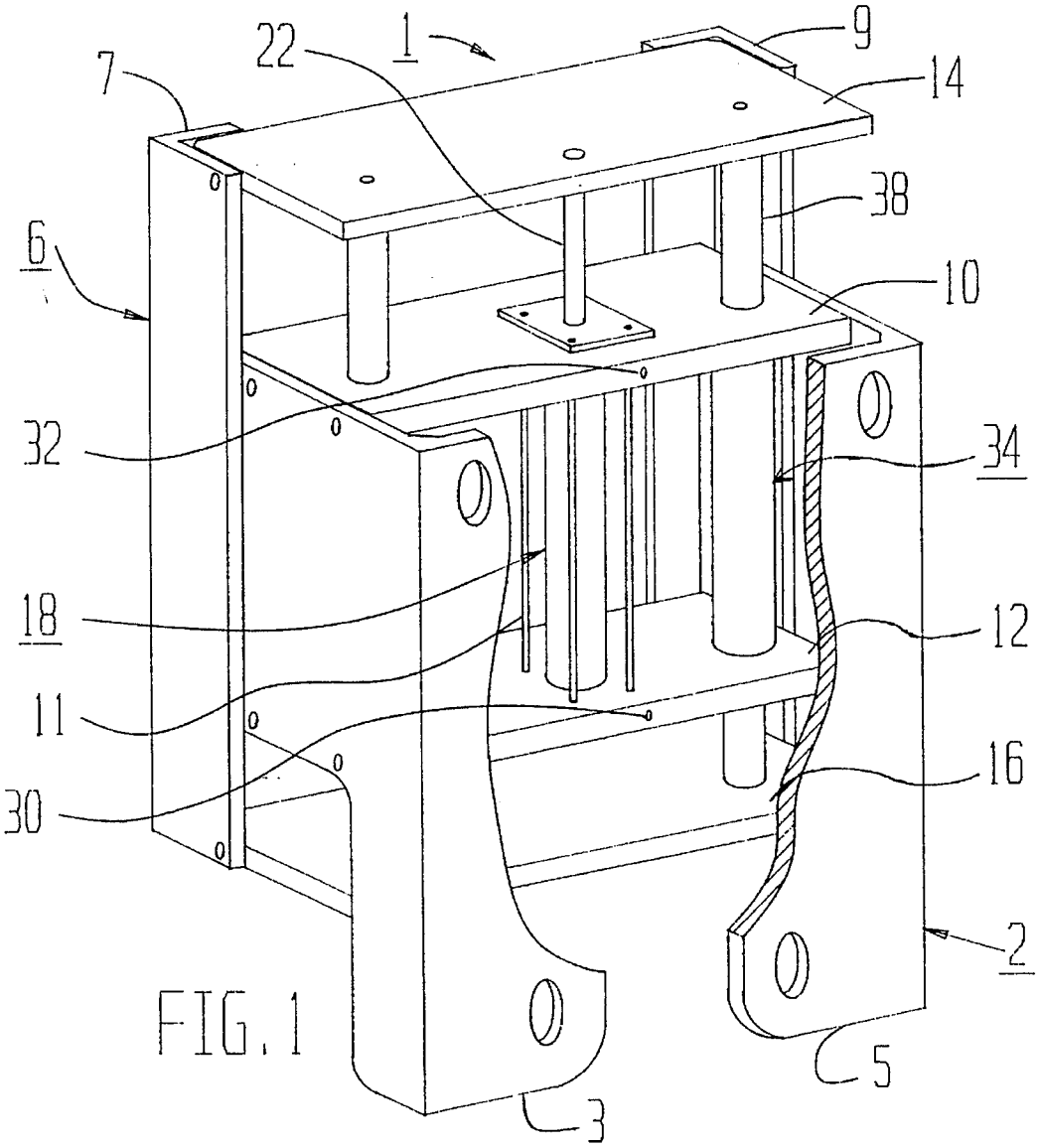
FIG. 1 is a partially broken away perspective view of a motor mount in accordance with the invention.
Figure 2:
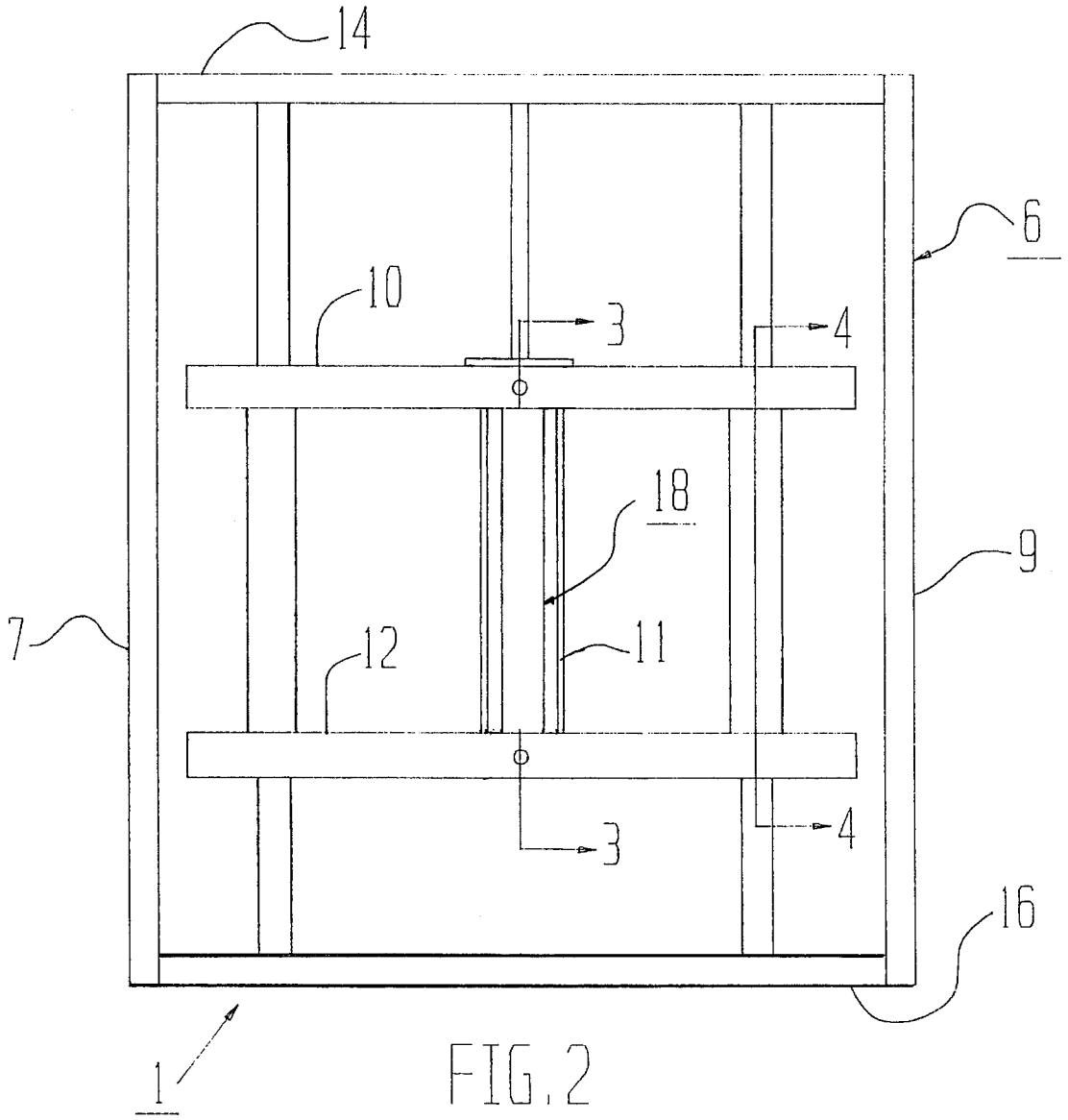
FIG. 2 is a front elevational view of a motor mounting bracket also showing the upper and lower plates of the transom bracket, the guides, and the actuating cylinder.

The motor mount 1 shown in FIGS. 1, 2, 5, and 6 comprises a first bracket 2 connected to the transom 4 of a boat, and a second bracket 6 connected to an outboard motor 8. The first bracket 2 includes a first plate 10 and a second plate 12. These plates 10 and 12 are rigidly connected together by side plates 3 and 5 and support rods 11, so that the first plate 10 is disposed above the second plate 12, as shown in FIGS. 1 and 2. The second bracket 6 includes a third plate 14 and a fourth plate 16. Plates 14 and 16 are rigidly connected together by side plates 7 and 9, so that the third plate 14 is disposed above the first plate 10, and the fourth plate 16 is disposed below the second plate 12, as shown in FIGS. 1 and 2.

Figure 3:
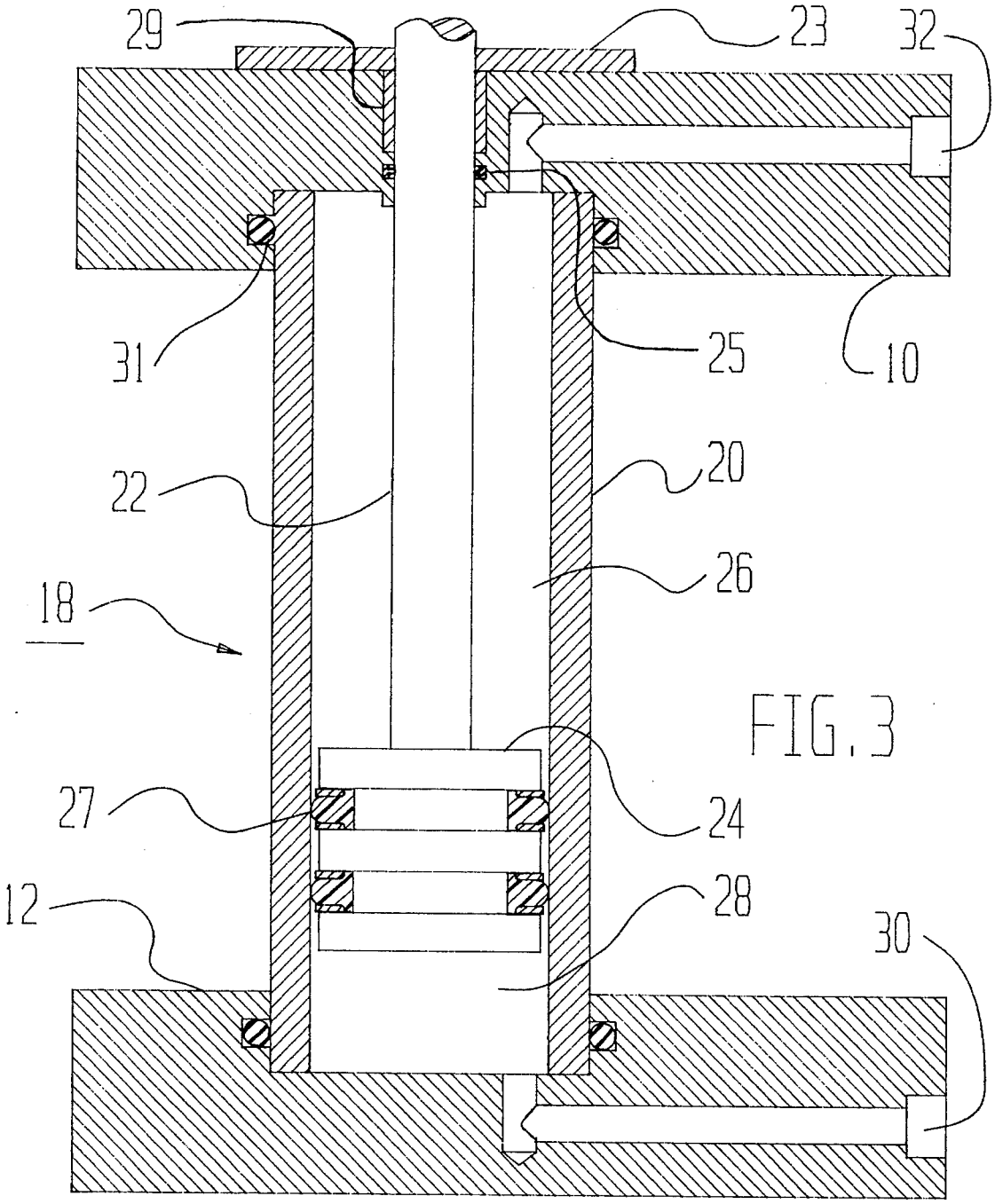
FIG. 3 is a sectional view of a motor mount, taken on plane 3—3 of FIG. 2, showing the hydraulic actuation assembly.

A fluid-driven actuator 18, shown in FIG. 3, effects movement of the second bracket 6 relative to the first bracket 2. The actuator 18 comprises an elongated, hollow cylinder 20 extending between, and recessed into, plates 10 and 12. O-rings 31 inserted into the recesses of plates 10 and 12 provide a fluid-tight seal between the cylinder 20 and plates 10 and 12.

A piston 24, slidable within the interior of the cylinder 20, is rigidly connected to one end of an elongated piston rod 22. Rod 22 extends upward from piston 24, along the axis of cylinder 20, and through an aperture in plate 10. Bearing 29, fixed to the inner wall of the aperture, guides rod 22. A T-seal 25 is located below bearing 29 in a slot in the wall of the aperture, and an outer seal 33 is provided above bearing 29 and held in place by a plate 23 attached to the upper face of plate 10. The seals prevent the entry of foreign objects into cylinder 20. Rod 22 is rigidly connected to plate 14.

The piston 24 has a groove provided with a similar T-seal 27 to divide the interior of the cylinder into an upper chamber 26 and a lower chamber 28, as shown in FIG. 3. A passage 30 extends through plate 12 from the front face of the plate to the bottom of the lower chamber 28. A similar passage 32, extends through plate 10 from the front face of the plate to the top of the upper chamber 26.

Hydraulic fluid enters into, and exits from, chambers 26 and 28 via tubes (not shown), received in passages 30 and 32. The height of the motor on the transom can be adjusted by selectively pumping hydraulic fluid into chambers 26 and 28. Fluid pumped into the lower chamber 28 through passage 30 pushes the piston 24 vertically upward. This displaces fluid in the upper chamber 26 out through passage 32. The piston rod 22 and second bracket 6 follow the upward movement of the piston 24, which consequently increases the height of the outboard motor 8 relative to the transom of a boat 4.

Hydraulic fluid pumped into the upper chamber 26 through passage 32 pushes the piston 24 downward. This displaces fluid in the lower chamber 28 out through passage 30. The piston rod 22 and second bracket 6 follow the downward movement of the piston 24, which consequently decreases the height of the outboard motor 8 relative to the transom of a boat 4.

Figure 4:
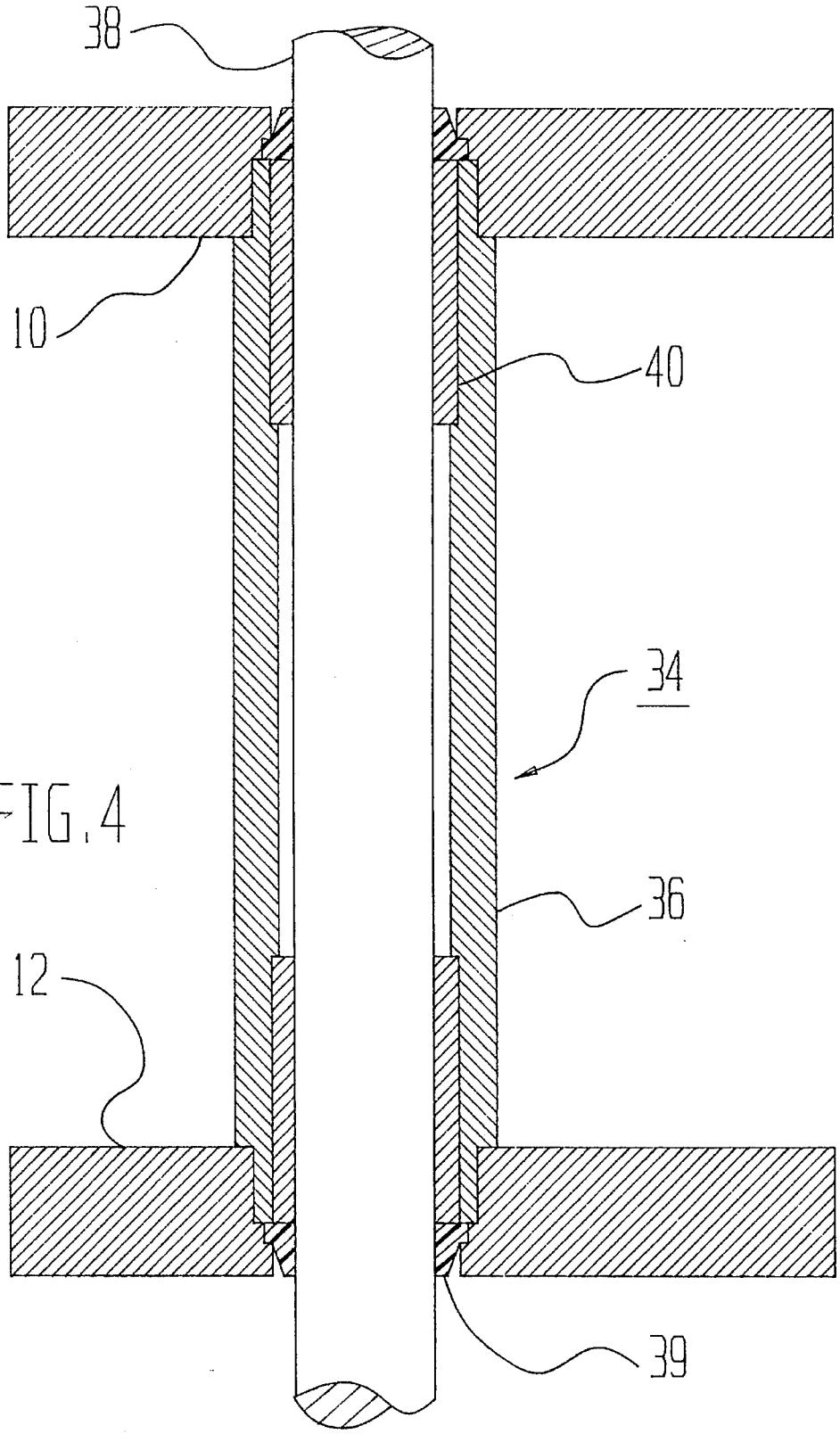
FIG. 4 is a sectional view of a motor mount, taken on plane 4—4 of FIG. 2, showing a guide assembly.
Figure 5:
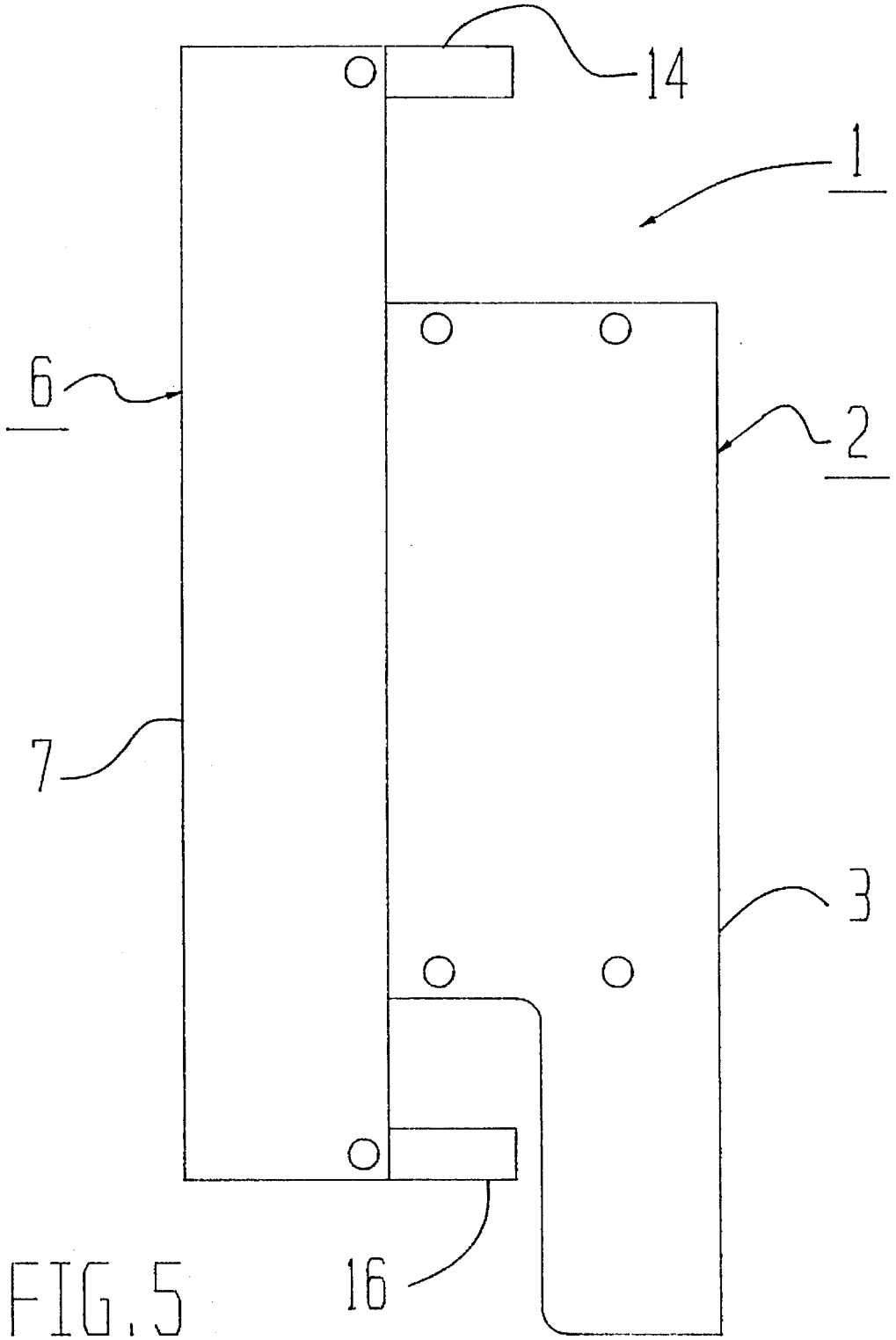
FIG. 5 is an elevational view showing the side of a motor mount.
Figure 6:
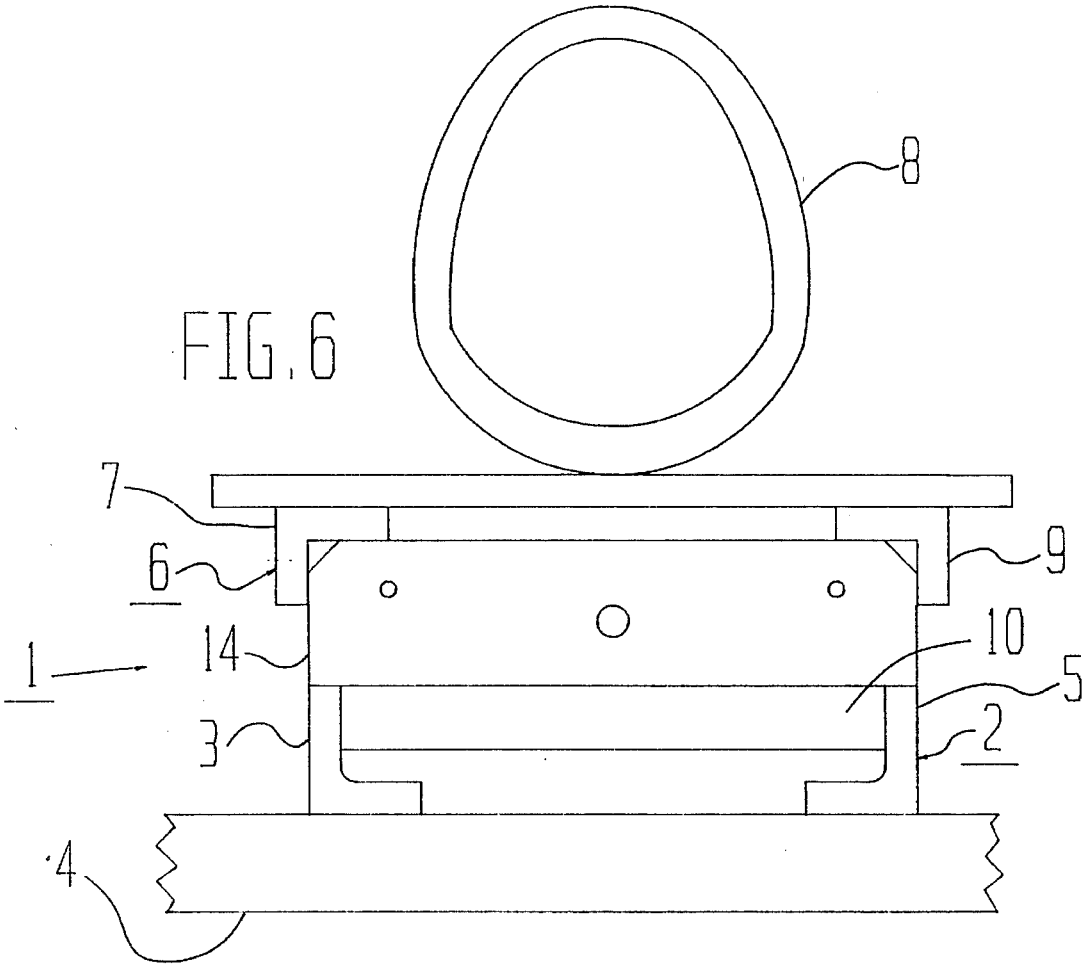
FIG. 6 is an elevational view showing the top of a motor mount connected to the transom of a boat and to an outboard motor.

Guide assemblies 34 constrain the movement of the second bracket 6 to a substantially vertical path when the first bracket 2 is connected to the transom of a boat 4. Each guide comprises a hollow, elongated tubular member 36 received in recesses in plates 10 and 12, as shown in FIG. 4. The walls of the recesses tightly fit the ends of tube 36 and hold it in fixed relationship to plate 10 and 12. Each guide also includes a rod extending between, and bolted to, plates 14 and 16.

The rod 38 extends through apertures provided in plates 10 and 12, and tubular member 36. Oil-impregnated bronze bearings 40, fitted to the inner wall of the tubular member 36, are separated from each other, one being adjacent to the upper end of tube 36 and the other being adjacent to the lower end of the tube. These bearings 40 guide the rod 38 in a straight, substantially vertical, path, and hold it against translation relative to its substantially straight, vertical path. The vertical separation of the upper and lower bearings ensures that the bracket assembly will sustain the large moment imposed on it by the weight of the outboard motor.

Graphite-impregnated synthetic resin seals 39, held in recesses in plates 10 and 12, prevent water and foreign objects from entering into tubular member 36, and also hold bearings 40 in place.

The motor mount in accordance with the invention maximizes outboard motor efficiency by making it possible to vary the height of a motor on the transom of a boat while the boat is in operation. The rod and tube guide assemblies rigidly maintain the second bracket in a substantially vertical path, without impeding its movement relative to the first bracket, thereby enhancing the strength, durability, and stability of the mechanism.

The large vertical separation of bearings 40 strengthen the bracket assembly, and seals 39 enhance its overall reliability.

Maximum stroke length is achieved by positioning the driving fluid passages so that hydraulic fluid enters and exits from the top of the upper chamber 26 and the bottom of the lower chamber 28.

Figure 7:
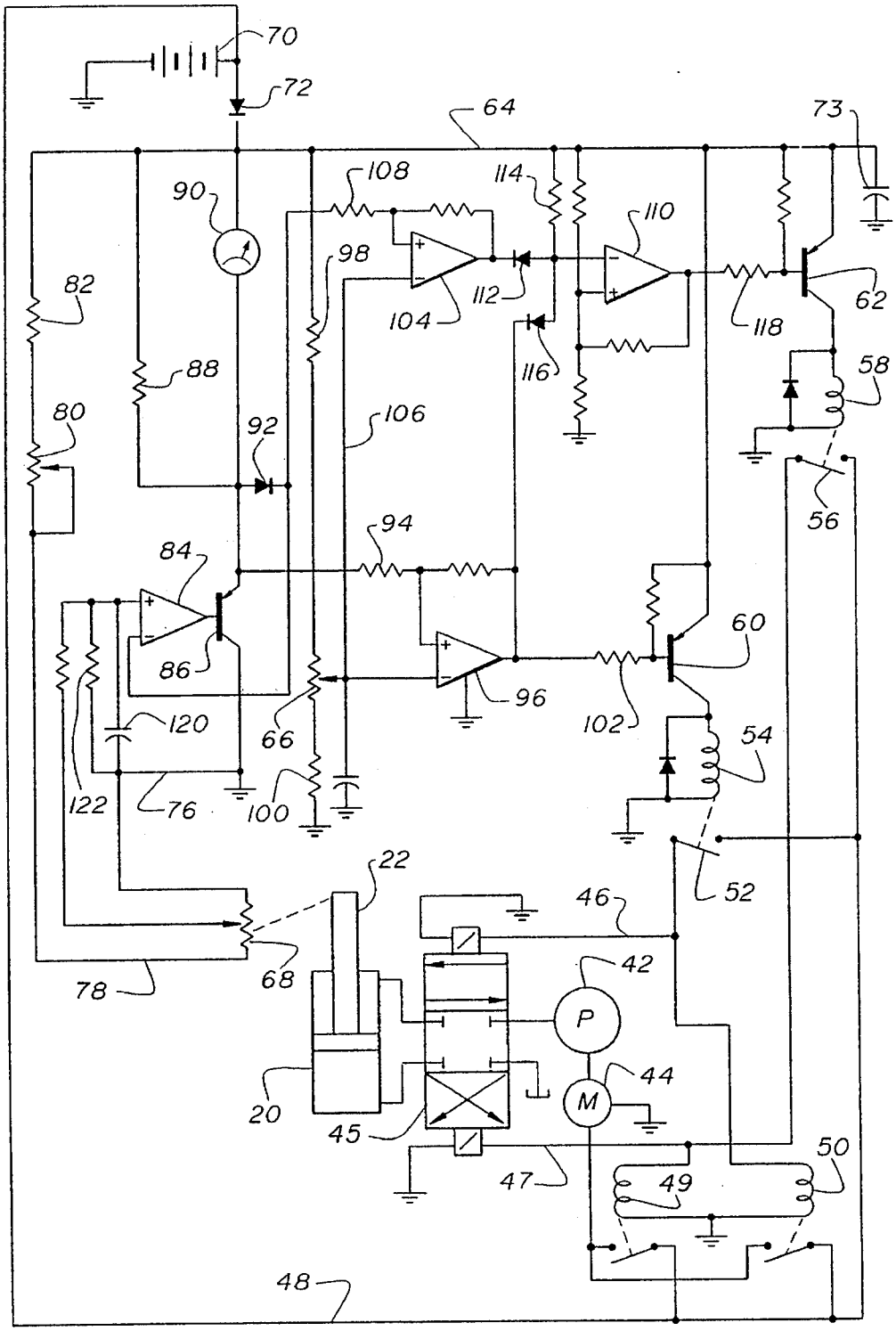
FIG. 7 is a schematic diagram of a preferred electrical control system for operating the hydraulic actuator.

To adjust the outboard motor to any desired height within the stroke of cylinder 20, the electrical control circuit shown in FIG. 7 is used to control the operation of hydraulic cylinder 20. A hydraulic pump 42 is operated by a DC motor 44, and delivers hydraulic fluid to cylinder 20 through a three-position, two-solenoid, reversing valve 45, the solenoids of which are electrically driven through lines 46 and 47 respectively from a positive supply line 48. Relays 49 and 50 are also connected to lines 46 and 47 respectively, and their contacts, which are normally open, deliver current to the motor when one or the other of the valve solenoids is energized. Thus, energization of line 46 activates valve 45 to direct hydraulic fluid to cylinder 20 so that the piston moves down, and simultaneously energizes relay 50 to activate the motor. Similarly energization of line 47 activates valve 45 to direct hydraulic fluid to cylinder 20 so that the piston moves up, and simultaneously energizes relay 49 to activate the motor.

Line 46 is connectible to positive supply line 48 through a set of normally open relay contacts 52, which are operable by relay solenoid 54. Line 47 is similarly connectible to positive supply line 48 through a set of normally open relay contacts 56, which are operable by relay solenoid 58. The solenoids 54 and 58 are energized through PNP transistors 60 and 62 respectively, the emitters of the transistors being connected to a positive supply bus 64. The solenoids are connected between the collectors of the transistors and ground, and are bypassed by protective diodes to prevent transistor damage due to inductive voltage spikes which would otherwise occur when the transistors go to cutoff.

The condition of the transistors is controlled in response to a servo circuit in which a command or "position" signal is produced by a variable resistor ("potentiometer" or "pot") 66, and a feedback, or "follow-up", signal is produced by variable resistor ("potentiometer" or "pot") 68. The command pot 66 is a rotary pot preferably positioned on the boat's control panel for easy access by the pilot. The follow-up pot 68 is also preferably a rotary pot mechanically connected, by a pulley, rack and pinion, or similar mechanism (not shown) to the piston rod 22, or to some portion of the movable motor-support bracket 6.

Both positive line 48 and positive supply bus 64 are connected to a boat's marine battery 70, the latter being connected to the battery through a diode 72. A large capacitor 73 is connected between bus 64 and ground to stabilize the voltage in bus 64. This prevents destabilization of the electronic circuitry when motor 44 is turned on, drawing a heavy current from the battery 70.

One end of the resistive portion of follow-up pot 68 is connected to ground through line 76, while the other end is connected to positive bus 64 through the series combination of pot 80 and resistor 82. Pot 80 is a calibration pot, and is manually controllable. The wiper of pot 68 is connected through a resistor to the "+" input terminal of an amplifier 84, which is preferably one of four operational amplifiers provided as a single integrated circuit. The output of amplifier 84 drives the emitter of a PNP transistor 86. The collector is grounded, and the emitter is connected, through a resistor 88, to positive bus 64. A voltmeter 90 is provided to display the voltage across resistor 88, which corresponds closely to the emitter current of transistor 86. As will become apparent, the emitter current in transistor 86 depends on the position of the follow-up pot 68, and therefore the reading of meter 90 continuously indicates the position of motor supporting bracket 6. The "–" input terminal of amplifier 84 is connected through diode 92 to the emitter of transistor 86.

The emitter of transistor 86 is connected, through a resistor 94, to the "+" input terminal of a second operational amplifier 96, the "–" input terminal of which is connected directly to the wiper of command pot 66. One end of the resistive element of pot 66 is connected through resistor 98 to the positive bus 64, and the other end is connected through resistor 100 to ground. Thus, amplifier 96 serves as a comparator to compare the voltage level at the wiper of pot 66, i.e. the command or position signal, with a feedback signal from transistor 86, which is responsive to the position of the wiper of follow-up pot 68. The output of amplifier 96 drives transistor 60 through resistor 102.

The wiper of pot 66 is also connected to the "–" input of a third amplifier 104 through line 106. The "+" input of amplifier 104 is connected, through resistor 108, to the cathode of diode 92, so that the forward voltage drop across diode 92 maintains a difference between the voltages at the "+" inputs of amplifiers 96 and 104.

The output of amplifier 104 is connected to the "–" input of a fourth amplifier 110 through a diode 112. Amplifier 110 serves as an inverter. Its "–" input is also connected to the positive bus 64 through resistor 114, and through a diode 116 to the output of amplifier 96. The output of amplifier 96 drives the base of transistor 62 through a resistor 118.

By-pass capacitors, for example capacitor 120, are provided at several locations in the circuit for noise suppression. A resistor 122 is connected between the "+" input of amplifier 84 and ground to bring the "+" input to ground potential in the event of an open circuit in the series of resistors connected between the "+" input and the positive bus 64.

In the operation of the circuit just described, an adjustment of command pot 66 by the pilot in a direction such that the "–" input of amplifier 96 goes more positive, causing the output of amplifier 96 to drive PNP transistor 60 into conduction to activate relay contacts 52. This, in turn, energizes the motor and causes the solenoid valve 45 to direct hydraulic fluid from the pump so that the piston in cylinder 20 moves in a direction such that follow-up pot 68 applies a positive-going potential to the "+" input of amplifier 84. Amplifier 84 then drives transistor 86 toward cut-off, so that the "+" input of amplifier 96 goes more positive. Transistor 60 then cuts off, the solenoid valve returns to its neutral position, and the motor stops, after bringing the piston in cylinder 20 to a new position corresponding to the position selected by the adjustment of the command pot.

In the operation just described, because the voltage at the output of amplifier 96 decreases, diode 116 goes into conduction, thereby preventing the "–" input of amplifier 110 from going positive relative to the "+" input. This prevents transistor 62 from activating relay solenoid 58 when relay solenoid 54 is activated.

When the command pot 66 is adjusted in the opposite direction, the voltage in line 106 goes more negative, causing the output of amplifier 96 to go more positive. This assures that transistor 60 is cut off, and at the same time places a reverse bias on diode 116. It also causes the "–" input of amplifier 104 to go less positive, thereby producing a positive-going output at the output of amplifier 104, reverse-biasing diode 112. With both of diodes 112 and 116 in the reverse-biased condition, the "–" input of amplifier 110 can be driven positive by current in resistor 114. The output of amplifier 110 then drives transistor 62 into conduction so that relay contacts 56 close and activate line 47, activating the motor, and causing the solenoid valve to direct hydraulic fluid from the pump to the lower portion of the cylinder to move the piston upward. The voltage at the wiper of the follow-up pot 68 decreases, causing the amplifier 84 to drive transistor 86 so that its emitter current increases. This reduces the voltage at the "+" input of amplifier 104, causing the output of amplifier 104 to decrease, and cutting off transistor 62, stopping the motor after bringing the piston in cylinder 20 to a new position corresponding to the position selected through the command pot.

The command pot 66 may be provided with mechanical detents (not shown) to facilitate selection of outboard motor positions. For example, the detents can be provided to correspond to 1/16 inch steps in movement of the outboard motor support bracket 6. If the total stroke of the motor mount is six inches, ninety-six detent steps should be provided.

Diode 92 serves as a "deadband" generator, in that its forward voltage drop imposes a difference on the potentials at the "+" input terminals of amplifiers 96 and 104, so that after the piston moves in one direction, a small movement of command pot 66 is necessary in order to initiate operation of the piston in the opposite direction. The deadband insures against oscillation of the servo system.

Diodes 112 and 116 serve as a NAND gate, requiring the outputs of amplifiers 96 and 104 both to be at high positive levels before inverting amplifier 110 can drive transistor 62 into conduction. This prevents both transistors 60 and 62 from going into conduction simultaneously.

As will be apparent from the foregoing, the circuit allows the pilot to select any height for the outboard motor within the range of relative motion of the transom and motor brackets. By simply twisting a control knob (not shown) connected to the command pot 66, the pilot can raise or lower the outboard motor immediately, while the boat is moving. The continuous adjustment allows the pilot to obtain optimum performance by adjusting the outboard motor height for increased speed or acceleration.

Various changes may be made to the described embodiment. For example, movement of the second bracket 6 relative to the first bracket 2 can be effected by an electric motor or device other than a fluid driven actuator. The piston can have a rod extending to both of the movable plates 14 and 16, not just to plate 14. The outboard motor can be mounted to bracket 2 while bracket 6 is secured to the boat transom.

Fluid entry and exit holes can be provided in the upper and lower chambers 26 and 28 of cylinder 20. This sacrifices stroke length, but obviates passages in plates 10 and 12.

Plates 14 and 16 can be rigidly connected together without using side plates 7 and 9. This rigid connection can instead be provided through direct attachment of plates 14 and 16 to the outboard motor 8. Likewise, plates 10 and 12 can be rigidly connected together without using side plates 3 and 5. This rigid connection can instead be provided through direct attachment of plates 10 and 12 to the transom of the boat 4.

Instead of using a two-solenoid, four-way valve to direct hydraulic fluid reversibly to the cylinder, a reversible pump may be used instead.

Still other modifications, which will occur to persons skilled in the art, may be made without departing from the scope of the invention as defined in the following claims.

We claim:

1. A motor mount for adjustably supporting an outboard motor from a transom of a boat, said motor mount comprising:

first and second brackets;

means for connecting one of said brackets to a transom;

means for mounting an outboard motor to the other of said brackets;

guide means, connected to said first and second brackets, for constraining said brackets to relative movement in a predetermined, substantially straight, path, said path being substantially vertical when said one of said brackets is connected to a transom by said connecting means;

means, connected to said first and second brackets, for effecting movement of said brackets relative to each other in said path;

in which said first bracket comprises first and second plates disposed with the first plate above the second plate, and means rigidly connecting said first and second plates together;

in which said second bracket comprises third and fourth plates, the third plate being located above said first plate and the fourth plate being located below said second plate, and means rigidly connecting the third and fourth plates together; and in which said guide means comprises at least one elongated tubular member extending from said first plate to said second plate, and being rigidly connected to said first and second plates, a rod extending through said tubular member, said rod being rigidly connected to said third and fourth plates, and means comprising a pair of bearings mounted in said tubular member, said bearings being spaced from each other in the direction of the length of said tubular member, said rod extending through said bearings and being slidable therein but held thereby against translation relative to said substantially straight path.

2. A motor mount according to claim 1 in which the means, connected to said first and second brackets, for effecting movement of said brackets relative to each other in said path, comprises a fluid-driven actuator having first and second relatively movable elements connected respectively to said first and second brackets and a pair of hydraulic fluid ports, means for applying hydraulic fluid under pressure to said hydraulic fluid ports, and control means for selectively directing hydraulic fluid alternatively to one or the other of said ports; in which said control means comprises command input means for entering a selected relative position for said brackets, position sensing means for providing a signal corresponding to the relative positions of said brackets, and means, responsive to the command input means and to the position sensing means, for directing hydraulic fluid to the hydraulic actuator to effect relative movement of said brackets in a direction to cause the relative position of said brackets to correspond to the selected position entered into the command input means.

3. A motor mount according to claim 2 in which said fluid-driven actuator comprises a hollow cylinder having an interior and a piston slidable within said cylinder, said cylinder extending between said first and second plates, and in which each of said first and second plates has a fluid passage communicating with the interior of the cylinder for conducting a driving fluid into and out of the interior of the cylinder.

4. A motor mount according to claim 2 in which said fluid-driven actuator comprises a hollow cylinder having an axis and extending between said first and second plates, a piston slidable within said cylinder along said axis, and a piston rod extending from said piston, along the axis of said cylinder, through one of said first and second plates and connected to one of said third and fourth plates.

5. A motor mount according to claim 1 in which said second bracket comprises a pair of side plates, each side plate being rigidly connected to the third and fourth plates.

6. A motor mount according to claim 1 in which the first bracket comprises a pair of side plates, each side plate being rigidly connected to the first and second plates.

7. A motor mount according to claim 1 in which said guide means comprises two tubular members, each tubular member extending from said first plate to said second plate and being rigidly connected to said first and second plates, and two rods extending respectively through said two tubular members, each of said rods being rigidly connected to said third and fourth plates, and means comprising a pair of bearings mounted in each of said tubular members, said bearings being spaced from each other in the direction of the length of the tubular member in which they are mounted, each said rod extending through both bearings in the tubular member through which it extends, and being slidable therein but held thereby against translation relative to said substantially straight path.

8. A motor mount according to claim 1 in which each of said first and second plates has, for each said elongated tubular member, a recess with a side wall and a bottom wall, and in which each said elongated tubular member is received in one said recess of said first plate and in one said recess of the second plate and held thereby in fixed relationship to said first and second plates.

9. A motor mount according to claim 1 in which the means, connected to the first and second brackets, for effecting movement of said brackets relative to each other in said path, comprises a fluid-driven actuator, in which each of said first and second plates has a recess with a side wall and a bottom wall, and in which said fluid-driven actuator comprises a hollow cylinder having an interior and a piston slidable within said cylinder, said cylinder extending between said first and second plates and being received in the recesses of said first and second plates.

10. A motor mount according to claim 1 including sealing means located in said tubular member adjacent to the ends thereof, said sealing means surrounding said rod and preventing debris and moisture from approaching said bearings.

11. A motor mount for adjustably supporting an outboard motor from a transom of a boat, said motor mount comprising:

first and second brackets;

means for connecting said first bracket to a transom;

means for mounting an outboard motor to said second bracket;

guide means, connected to said first and second brackets, for constraining said second bracket to movement in a predetermined, substantially straight, path, said path being substantially vertical when the first bracket is connected to a transom by said connecting means;

means, connected to said first and second brackets for effecting movement of said second bracket relative to said first bracket in said path;

in which said first bracket comprises first and second plates disposed with the first plate above the second plate, and means rigidly connecting said first and second plates together;

in which said second bracket comprises third and fourth plates, the third plate being located above said first plate and the fourth plate being located below said second plate, and means rigidly connecting the third and fourth plates together; and in which said guide means comprises at least one elongated tubular member extending from said first plate to said second plate, and being rigidly connected to said first and second plates, a rod extending through said tubular member, said rod being rigidly connected to said third and fourth plates, and means comprising a pair of bearings mounted in said tubular member, said bearings being spaced from each other in the direction of the length of said tubular member, said rod extending through said bearings and being slidable therein but held thereby against translation relative to said substantially straight path.

12. A motor mount according to claim 11 in which the means, connected to said first and second brackets for effecting movement of said second bracket relative to said first bracket in said path, comprises a fluid-driven actuator having first and second relatively movable elements connected respectively to said first and second brackets and a pair of hydraulic fluid ports, means for applying hydraulic fluid under pressure to said hydraulic fluid ports, and control means for selectively directing hydraulic fluid alternatively to one or the other of said ports; in which said control means comprises command input means for entering a selected position for said second bracket, position sensing means for providing a signal corresponding to the position of said second bracket, and means, responsive to the command input means and to the position sensing means, for directing hydraulic fluid to the hydraulic actuator to effect movement of said second bracket in a direction to cause the position of said second bracket to correspond to the selected position entered into the command input means.

13. A motor mount according to claim 12 in which said fluid-driven actuator comprises a hollow cylinder having an interior and a piston slidable within said cylinder, said cylinder extending between said first and second plates, and in which each of said first and second plates has a fluid passage communicating with the interior of the cylinder for conducting a driving fluid into and out of the interior of the cylinder.

14. A motor mount according to claim 12 in which said fluid-driven actuator comprises a hollow cylinder having an axis and extending between said first and second plates, a piston slidable within said cylinder along said axis, and a piston rod extending from said piston, along the axis of said cylinder, through one of said first and second plates and connected to one of said third and fourth plates.

15. A motor mount according to claim 11 in which said second bracket comprises a pair of side plates, each side plate being rigidly connected to the third and fourth plates.

16. A motor mount according to claim 11 in which the first bracket comprises a pair of side plates, each side plate being rigidly connected to the first and second plates.

17. A motor mount according to claim 11 in which said guide means comprises two tubular members, each tubular member extending from said first plate to said second plate and being rigidly connected to said first and second plates, and two rods extending respectively through said two tubular members, each of said rods being rigidly connected to said third and fourth plates, and means comprising a pair of bearings mounted in each of said tubular members, said bearings being spaced from each other in the direction of the length of the tubular member in which they are mounted, each said rod extending through both bearings in the tubular member through which it extends, and being slidable therein but held thereby against translation relative to said substantially straight path.

18. A motor mount according to claim 11 in which each of said first and second plates has, for each said elongated tubular member, a recess with a side wall and a bottom wall, and in which each said elongated tubular member is received in one said recess of said first plate and in one said recess of the second plate and held thereby in fixed relationship to said first and second plates.

19. A motor mount according to claim 11 in which the means, connected to the first and second brackets, for effecting movement of said brackets relative to each other in said path, comprises a fluid-driven actuator, in which each of said first and second plates has a recess with a side wall and a bottom wall, and in which said fluid-driven actuator comprises a hollow cylinder having an interior and a piston slidable within said cylinder, said cylinder extending between said first and second plates and being received in the recesses of said first and second plates.

20. A motor mount according to claim 11 including sealing means located in said tubular member adjacent to the ends thereof, said sealing means surrounding said rod and preventing debris and moisture from approaching said bearings.

* * * * *